US007458742B2

(12) United States Patent
Stropkay et al.

(10) Patent No.: US 7,458,742 B2
(45) Date of Patent: Dec. 2, 2008

(54) DOOR HANDLE DISPENSER FOR SANITIZING LIQUIDS

(75) Inventors: Edward J. Stropkay, 9215 Wilson Mills Rd., Chesterland, OH (US) 44026; Robert Soreo, Cleveland Heights, OH (US); Jeffery Kalman, Cleveland Heights, OH (US)

(73) Assignee: Edward J. Stropkay, Chesterland, OH (US)

( * ) Notice: Subject to any disclaimer, the term of this patent is extended or adjusted under 35 U.S.C. 154(b) by 253 days.

(21) Appl. No.: 11/417,478

(22) Filed: Apr. 27, 2006

(65) Prior Publication Data

US 2006/0245818 A1 Nov. 2, 2006

Related U.S. Application Data

(60) Provisional application No. 60/675,376, filed on Apr. 27, 2005.

(51) Int. Cl.
*B05C 21/00* (2006.01)

(52) U.S. Cl. ..... 401/205; 401/133; 401/134

(58) Field of Classification Search ..... 401/198, 401/199, 205, 207, 132, 133, 134; 15/244.1
See application file for complete search history.

(56) References Cited

U.S. PATENT DOCUMENTS

| | | | | |
|---|---|---|---|---|
| 2,527,955 | A * | 10/1950 | Pagel | 422/291 |
| 3,886,863 | A * | 6/1975 | Carabott et al. | 101/125 |
| 4,832,942 | A * | 5/1989 | Crace | 428/41.1 |
| 5,042,690 | A * | 8/1991 | O'Meara | 222/83 |
| 6,211,788 | B1 * | 4/2001 | Lynn et al. | 340/573.1 |
| 6,645,435 | B2 * | 11/2003 | Dawson et al. | 422/110 |
| 6,874,697 | B2 * | 4/2005 | Callueng | 239/1 |

* cited by examiner

*Primary Examiner*—David J Walczak
(74) *Attorney, Agent, or Firm*—Fay Sharpe LLP

(57) ABSTRACT

A door handle and liquid dispensing apparatus includes a housing configured to attach to an associated door and a porous material. The housing at least partially defines a reservoir configured to hold a liquid for cleaning a person's hand when the person opens the associated door. The porous material is disposed in and extends from the reservoir. A portion of the porous material is disposed adjacent a location typically touched by the person's hand when opening the associate door.

11 Claims, 10 Drawing Sheets

DOOR HANDLE DISPENSER FOR SANITIZING LIQUIDS

This application claims the benefit of U.S. Provisional Patent Application No. 60/675,376, filed Apr. 27, 2005, which is incorporated by reference herein.

BACKGROUND

Washing one's hands with soap or a sanitizing cleanser is an extra step that many people want to avoid when visiting a mens room or a ladies restroom. Large facilities, for example cruise ships, stadiums, schools and the like, typically include liquid soap dispensers adjacent sinks. For liquid soap dispensers, pumps do not always work and people may not feel comfortable using them. Furthermore, it takes time to wash one's hands in a sink and people typically want to limit their time in a public restroom.

SUMMARY OF THE INVENTION

It would be desirable to combine the function of opening a door, such as a door to a men's or ladies' restroom, with hand cleansing and/or sanitizing. In other words, it would be automatic that when one opens the door, whether it is by pushing or pulling, a liquid hand cleaner would be deposited onto his hands.

An embodiment of such an apparatus includes a door handle and liquid dispensing apparatus that includes a housing configured to attach to an associated door and a porous material attached to the housing. The housing at least partially defines a reservoir configured to hold a liquid for cleaning a person's hand when the person opens the associated door. The porous material is disposed in and extends from the reservoir. A portion of the porous material is disposed adjacent a location typically touched by the person's hand when opening the associated door.

A method for providing a hand cleaning liquid to a person includes placing a container of hand cleaning liquid into a door handle assembly. The door handle assembly includes a mounting member configured to attach to a door, a hand grasping or pushing section connected to the mounting member and a porous material in fluid communication with the container of hand cleaning liquid and the hand grasping or pushing section. Hand cleaning liquid from the container travels towards the hand grasping or pushing section via the porous material.

In yet another embodiment, a door handle liquid dispensing assembly includes a hand contact section, a mounting member connected to the hand contact section, a reservoir connected to the hand contact section and/or the mounting member, and a fluid path in communication with the reservoir and the hand contact section. The mounting member is configured to mount to an associated door. The reservoir is configured to hold a cleaning liquid for cleaning a person's hands. The fluid path is for delivering cleaning liquid from the reservoir towards the hand contact section.

DETAILED DESCRIPTION

Figure 1:
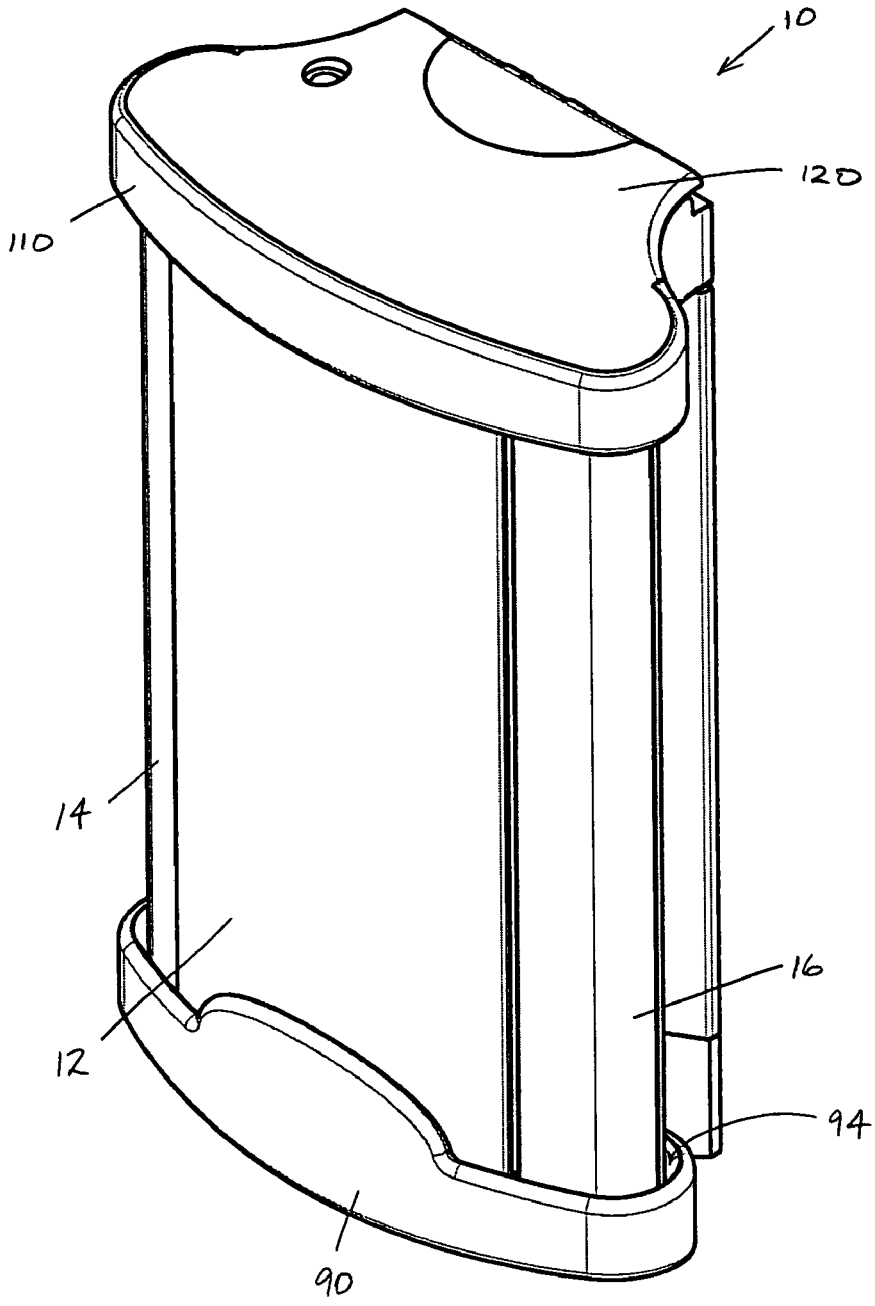
FIG. 1 is a perspective view of a door handle dispenser for sanitizing liquid.

A door handle and hand cleaning liquid dispensing assembly 10 is configured to mount to a door (not shown) such as a door to a mens or ladies restroom, as well as to other doors leading to other locations where it might be desirable to clean the hands of persons entering and exiting the room. The embodiment of the assembly 10 depicted in FIG. 1 is configured to provide hand sanitizing and/or hand cleaning liquid, which includes lotion, to a person whether the person pushes against the assembly 10 to open the door or pulls the assembly 10 to open the door. The assembly 10 is described as a "door handle" assembly; however, the term "door handle" or "handle" is not limited to simply a bar that is grasped and pulled to open the door to which the bar is attached. The term "door handle" or "handle" as used herein refers to a portion of the assembly that is typically touched by the person's hand when opening the door, whether it be by pushing or pulling the door.

Figure 2:
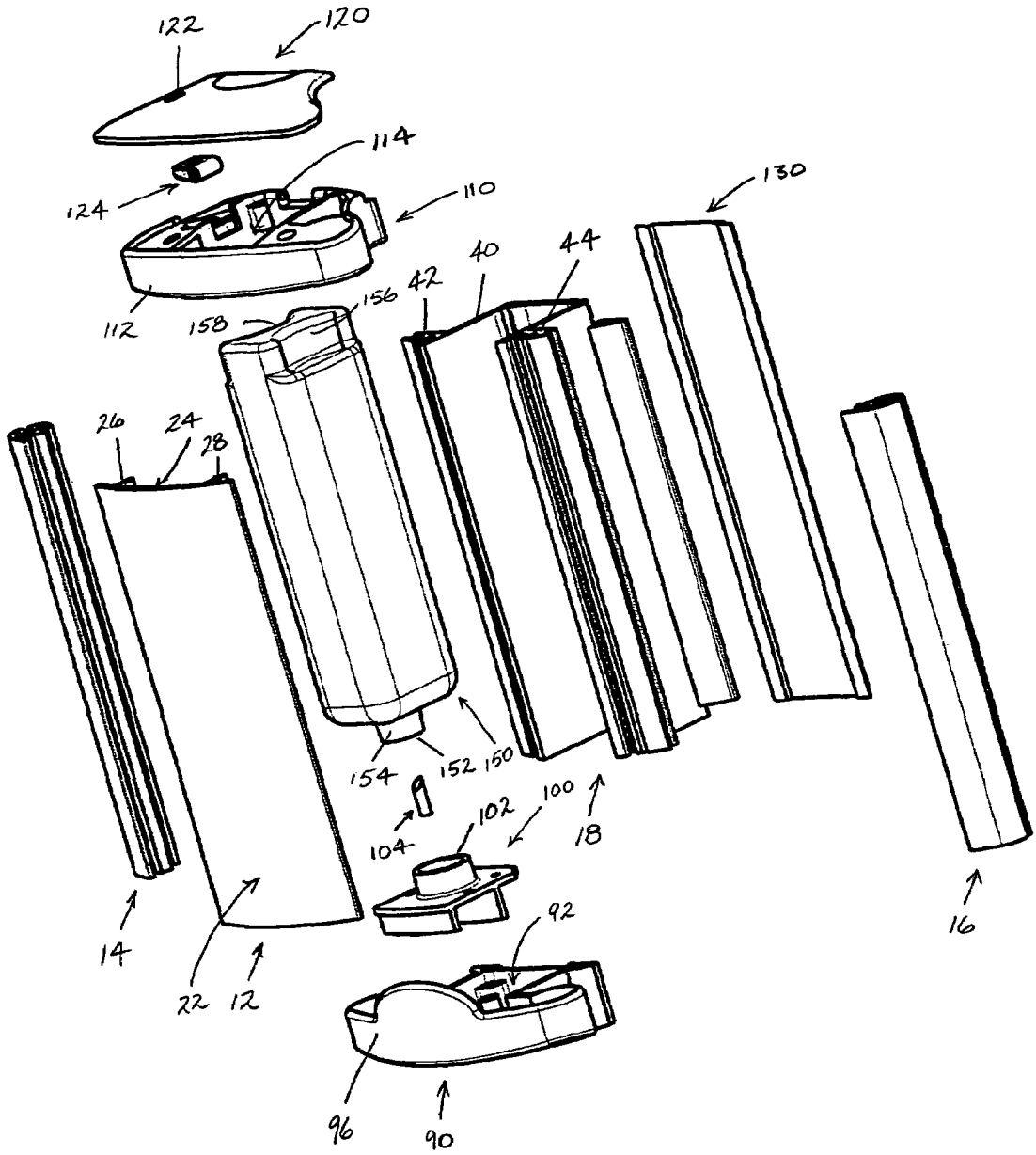
FIG. 2 is an exploded view of the dispenser of FIG. 1.
Figure 3:
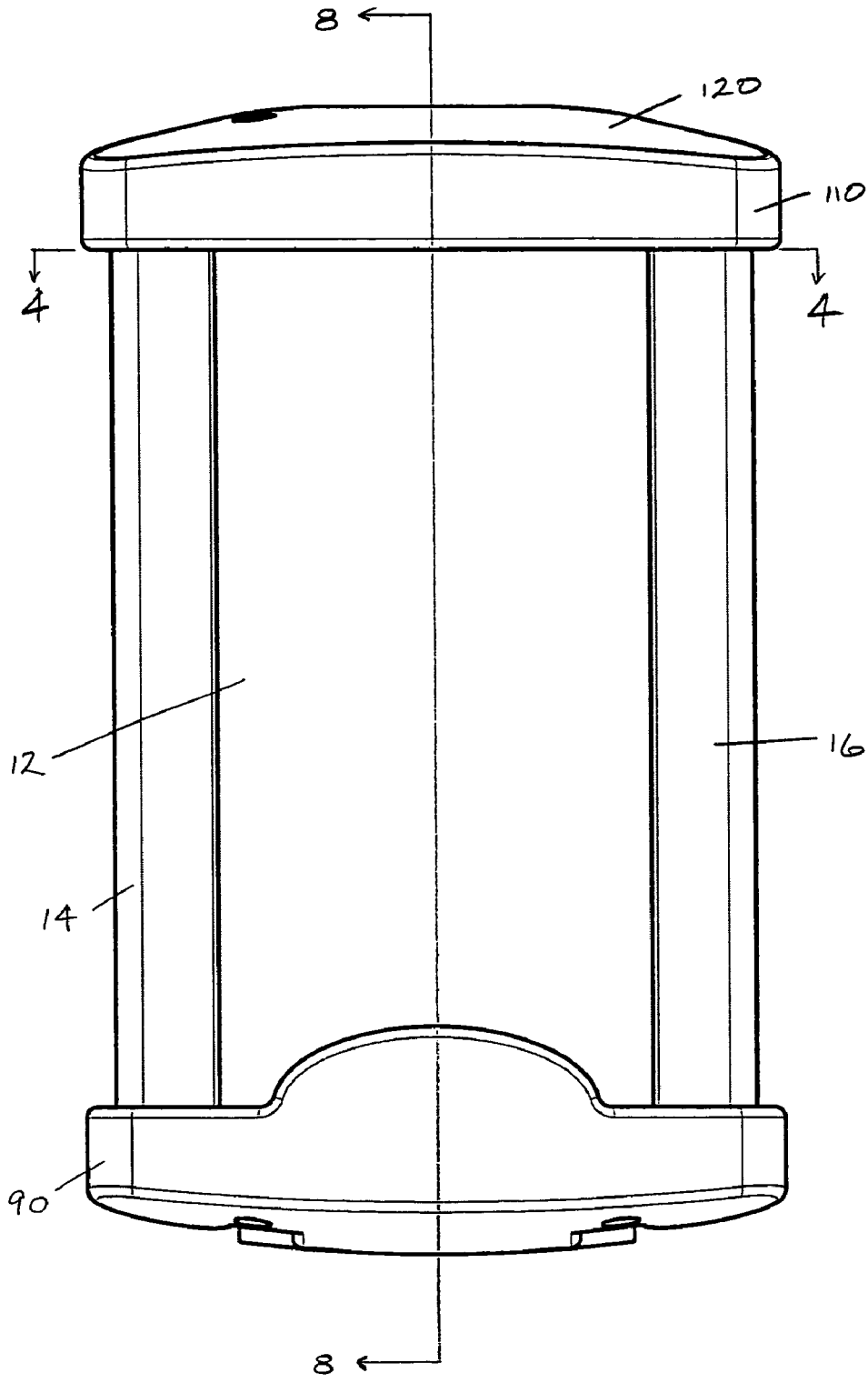
FIG. 3 is a front elevation view of the dispenser of FIG. 1.

With reference to FIG. 2, the assembly 10 includes a push plate 12 and first and second handle bars 14 and 16, respectively, that each attach to a main housing section 18. The push plate 12 and the handle bars 14 and 16 generally define a portion of the assembly that is to be pushed or grasped by a person opening the door. As will be described in more detail below, when a person's hand contacts these sections of the assembly 10 a hand cleaning liquid, which will typically not require water in order to be rinsed from the hands, is deposited on the person's hands.

The push plate 12 defines a generally curved exterior or outer surface 22 and a complementary shaped, i.e. generally parallel, interior surface 24. Barbs 26 and 28 are spaced from one another and extend from the inner surface 24 towards the main housing section 18. As is more clearly seen in FIG. 4, each barb includes a dove-tailed section 32 and 34, respectively, for attaching the push plate 22 to the main housing section 18 in a manner that will be described in more detail below.

Figure 4:
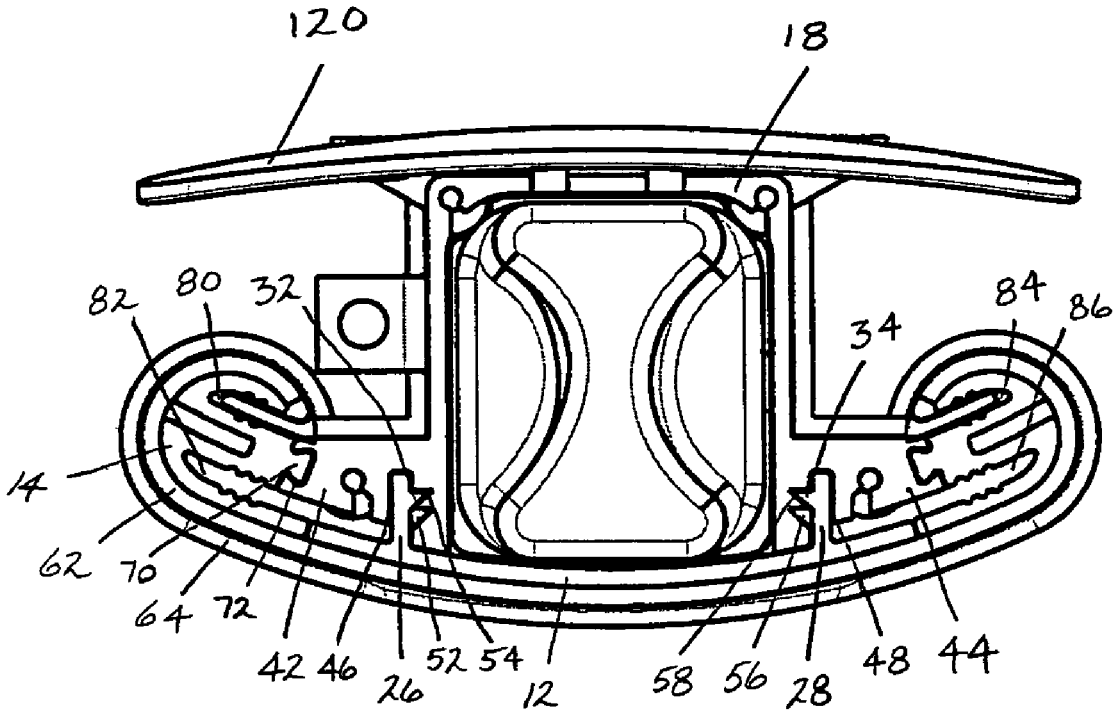
FIG. 4 is a cross-sectional view of the dispenser of FIG. 1 taken along line 4-4 of FIG. 3 and a lid for the dispenser is shown in an open position.

With reference back to FIG. 2, the main housing section 18 includes a generally U-shaped section 40 and first and second forward wings 42 and 44, respectively, that each extend from a respective terminal portion of the U-shaped section. With reference back to FIG. 4, the main housing section 18 defines barb-receiving main channels 46 and 48 disposed adjacent the ends of the U-shaped section 40. In the depicted embodiment, the first barb-receiving channel 46 includes a first (forward) keyway 52 and a second (rearward) keyway 54. Similarly, a first (forward) keyway 56 and a second (rearward) keyway 58 extend from the second barb-receiving channel 48. The keyways 52 and 54 are configured to receive the dove-tailed section 32 of the first barb 26 and the keyways 56 and 58 are configured to receive the dove-tailed section 34 of the second barb 28 so that the push plate 12 can attach to the main housing 18 in at least two positions: a forward and a rearward position. When the dove-tailed sections 32 and 34 are received in the forward most keyways 52 and 56, respectively, the external surface 22 of the push plate 12 is at least substantially flush with an exterior surface of the assembly 10, which will be described in more detail below. The push plate 12 will typically be disposed in the forward location when the assembly 10 is attached to the door in a manner such that the handle bars 14 and 16 will be grasped and pulled to open the door. The dove-tailed sections 32 and 34 are received in the rearward keyways 54 and 58 so that the exterior surface 22 is offset rearwardly so that a porous material 62 and a screen 64, which is the configuration depicted in FIG. 4, are disposed adjacent the exterior surface 22 of the push plate 12. It is in this configuration that the assembly 10 will be pushed by a person to open the door to which the assembly is attached. The push plate 12 can attach to the main housing 18 in other manners, for example using fasteners, if desired.

As indicated above, the handle bars 14 and 16 connect to the main housing 18. The first handle bar 14 connects to the first wing 42 of the main housing 18 and the second handle bar 16 connects to the second wing 44 of the main housing. The wings 42 and 44 and the handle bars 14 and 16 are mirror images of one another in the depicted embodiment. Accordingly, for the sake of brevity only the connection of the first handle bar 14 to the first wing 42 of the main housing 18 will be described in detail. As most clearly seen in FIG. 4, the first handle bar 14 includes a dove-tail extension 70 that is received inside an appropriately shaped channel 72 of the first wing 42. Attachment can be made between the main housing 18 and the handle bar 14 in other conventional manners. The handle bars 14 and 16 are rod-like in structure and attach to the main housing section 18 in a manner so that they can provide an adequate gripping structure for a person to grasp when opening a door to which the assembly 10 is attached.

With continued reference to FIG. 4, each handle bar 14 and 16 includes channels that accept the aforementioned screen 64 (as well as another screen that will be described below). As per the orientation depicted in FIG. 4, the first handle bar 14 includes a rearward channel 80 and a forward channel 82. Similarly, the second handle bar 16 includes a rearward channel 84 and a forward channel 86. The attachment of the screen 64 will be described in more detail below.

With reference back to FIG. 2, a bottom cap 90 attaches to a lower end of the main housing 18. Fasteners (not shown) are used to provide the connection. The bottom cap 90 defines a reservoir 92 that stores hand cleaning liquid and/or lotion. The bottom cap 90 is appropriately shaped to receive the main housing 18, the push plate 22 and the handle bars 14 and 16 while defining a channel 94 (FIG. 1) between the aforementioned components and a peripheral wall 96 of the bottom cap 90. This channel 94 accommodates the porous material 62 and the screen 64 (as well as the other screen and porous materials that will be described below) in a manner that will be described in more detail below.

A bottle plate insert 100 is received inside and attaches to the bottom cap 90. The bottle plate insert 100 includes an upwardly extending hollow boss 102, which is circular in configuration in the depicted embodiment. A hollow bottle-piercing needle 104 is centrally located within the hollow boss 102 of the bottle plate insert 100.

A top cap 110 attaches to an upper end of the main housing 18. The top cap 110 has a similar configuration to the bottom cap 90 in that the top cap is also appropriately shaped to receive the main housing 18, the push plate 12 and the handle bars 14 and 16 (as well as the appropriate screens and porous materials). Similar to the bottom cap 90, the top cap 110 defines a space or channel (not visible) between the handle bars 14 and 16 and the push plate 22 and an outer peripheral wall 112 of the top cap 110 to accommodate the porous material 62 and the screen 64. The top cap 110 also defines an opening 114, which in the depicted embodiment is substantially rectangular and of similar dimension to the U-shaped portion 40 of the main housing 18.

Figure 7:
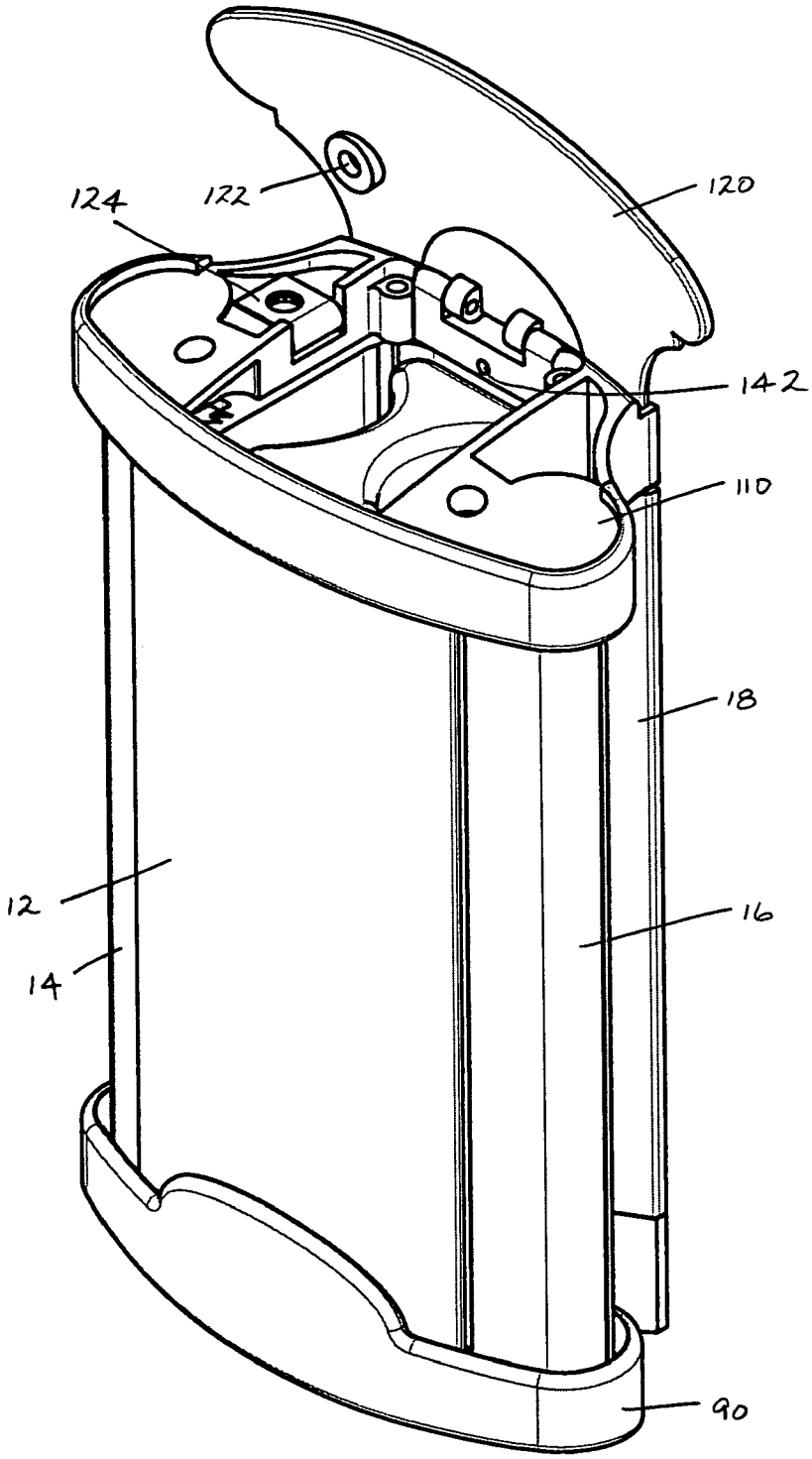
FIG. 7 is a front perspective view of the dispenser of FIG. 1 showing a lid of the dispenser in an open position.

A lid 120 hingedly attaches to the top cap 110 to provide access to internal components of the assembly 10 (see also FIG. 7). The lid includes an opening 122 that can receive a special fastener that is threadingly received in a quarter turn retainer 124. The fastener and the quarter turn retainer 124 provide selective access to the internal components since the fastener would be appropriately shaped so that a special tool is required to remove the fastener to provide access to the internal components of the assembly 10.

Figure 5:
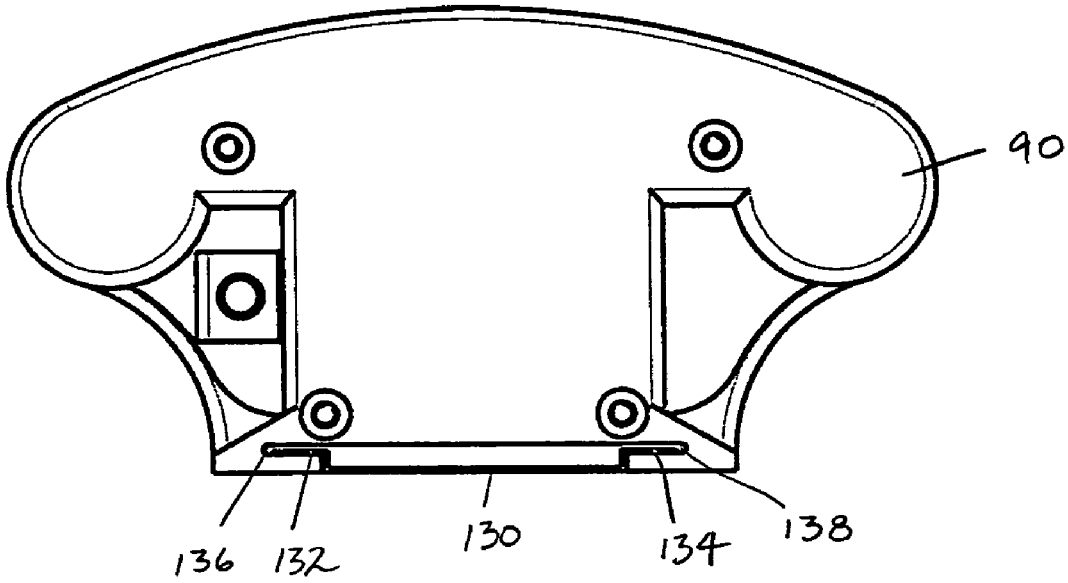
FIG. 5 is a lower plan view of the dispenser shown in FIG. 1.
Figure 6:
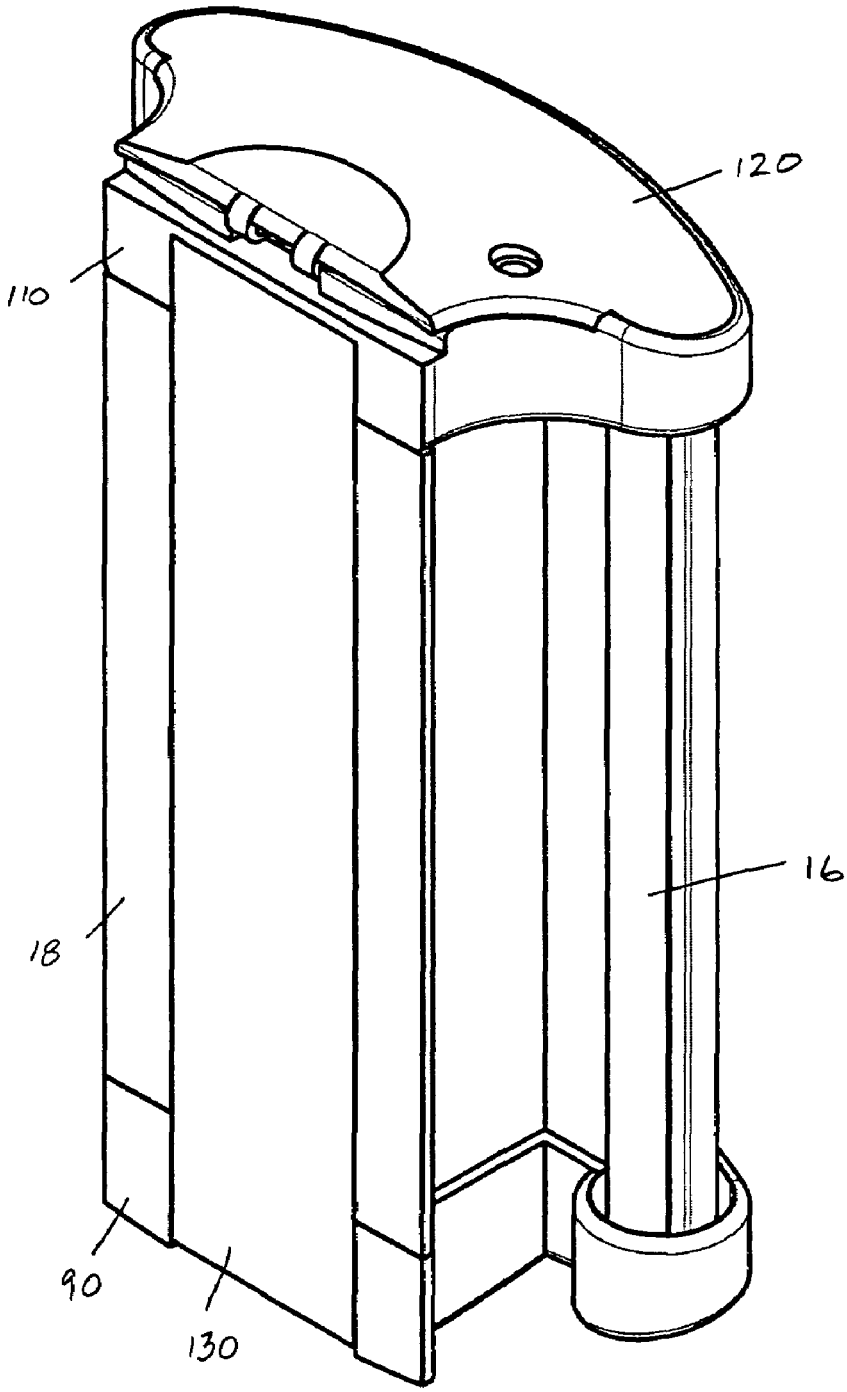
FIG. 6 is a rear perspective view of the dispenser of FIG. 1.

An attachment plate 130 selectively attaches to the main housing 18. The attachment plate 130 mounts to the door, or another structure such as a wall, table, or the like. Accordingly, the assembly 10 need not attach or mount to a door. With reference to FIG. 5, the mounting plate 130 is formed in a manner such that it includes flanges 132 and 134 that are received in respective channels 136 and 138 formed in the main housing 18, the lower cap 90 and the top cap 110. With reference to FIG. 6, the mounting plate 130 does not extend through the top cap 110. Accordingly, the assembly 10 can be slid onto the mounting plate 130 and the top cap 110 can stop further downward movement of the assembly. With reference to FIG. 7, an opening 142 is provided in the top cap 110. The opening 142 allows for a set screw (not shown) to be screwed into the opening 142 and contact the mounting plate 130 so that the assembly 10 cannot be removed from the mounting plate 130 unless the lid 120 is opened. Since the lid 120 cannot be opened without removal of the special fastener, removal of the assembly 10 from the mounting plate 130 is inhibited.

Figure 8:
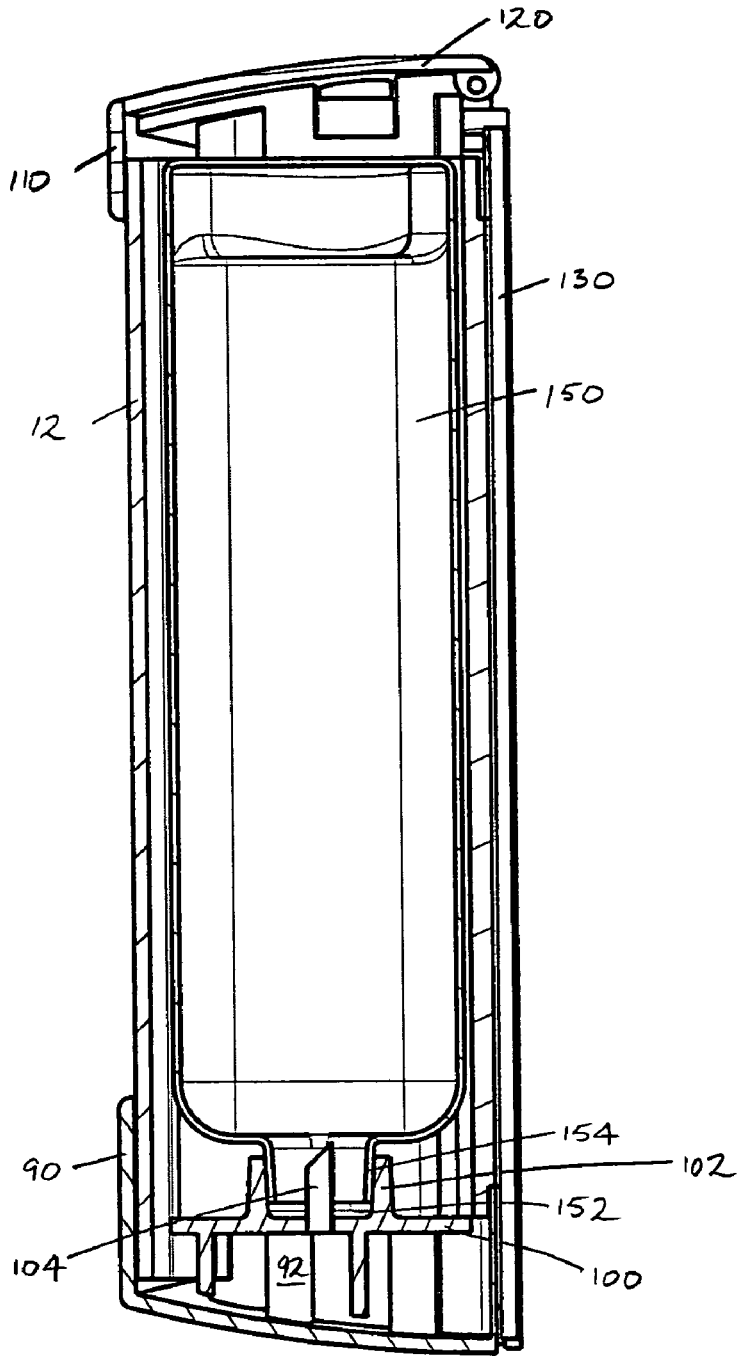
FIG. 8 is a cross-sectional view of the dispenser of FIG. 1 taken along line 8-8 of FIG. 3.

With reference back to FIG. 2, a bottle 150 of hand cleaning or hand sanitizing liquid (which includes lotions) is received in the U-shaped portion 40 of the main outer housing 18. Typically, the bottle 150 includes a sealed cap 152 (see also FIG. 8) at a neck 154 of the bottle. The sealed cap 152 is pierced by the hollow needle 104 when the neck 154 is received inside the boss 102 and the hand cleaning liquid flows into the reservoir 92 via gravity flow (see also FIG. 8). By providing a sealed cap 152, the bottle 154 can be easily placed inside the main housing 18 without spilling any liquid. This reduces mess and also provides a sanitary liquid product. In the depicted embodiment, the bottle 150 includes contoured indentations 156 and 158 at an end opposite the neck 154. The indentations 156 and 158 provide an easy hand gripping location so that the bottle 150 can be easily removed from the main housing 18 when empty.

Figure 9:
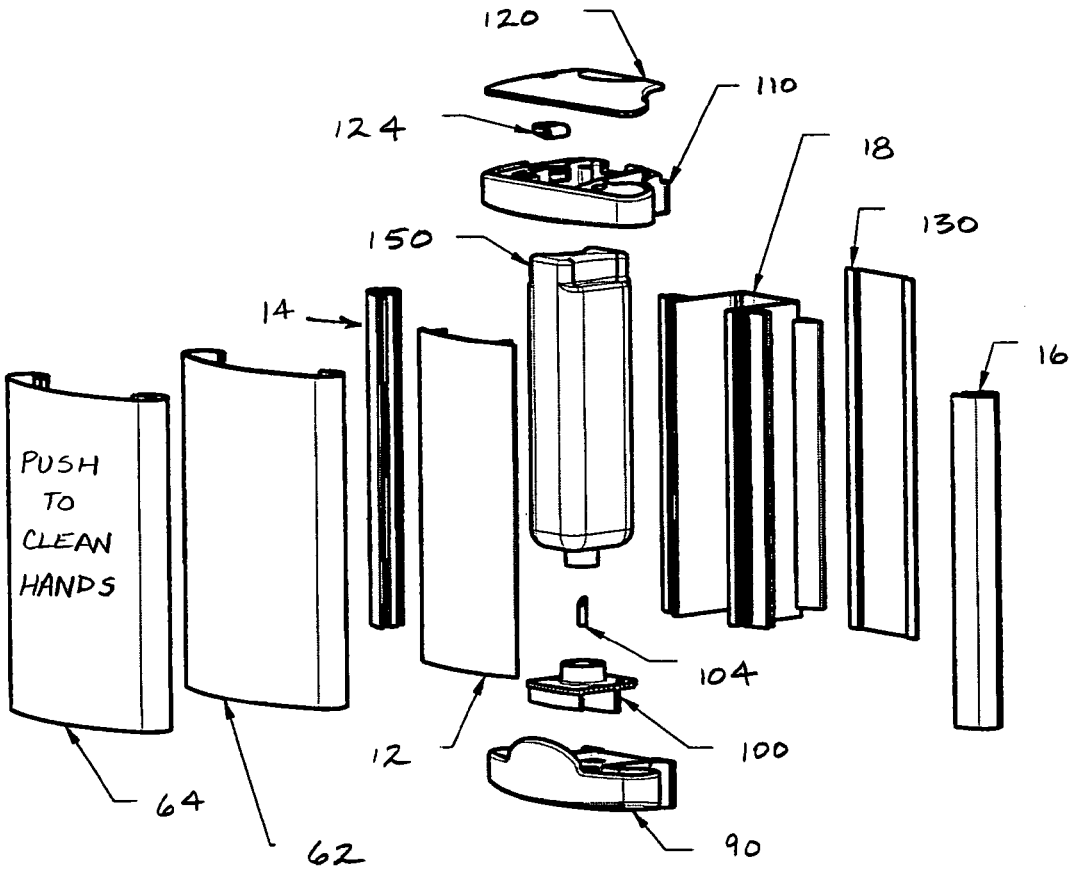
FIG. 9 is an exploded view of the dispenser of FIG. 1 showing a screen and porous material for use with the dispenser when used in a push plate door handle operating position.

With reference to FIG. 9, the screen 64 and porous material 62 for use with the assembly when the assembly acts as a push plate-type handle assembly is shown. The porous material 62 provides a fluid path between the reservoir 92 and a portion of the assembly that comes in contact with a person's hand. The porous material 62 extends upwardly from the bottom cap 90 such that it is in fluid communication with the reservoir 92. In the embodiment depicted in FIGS. 4 and 9, the porous material 62 is disposed adjacent the exterior surface 22 of the push plate 12. The porous material 62 can include an open-celled hygroscope material such as a sponge and/or an open-celled plastic having omni-directional pores. Such a plastic material is available from Porex Corporation. The porous material, in the depicted embodiment, wicks the hand cleaning liquid from the reservoir 92 towards a hand grasping or pushing section (typically defined by the push plate 12 or handle bars 14 and 16) of the assembly 10. The dimensions of the porous material 62, e.g. thickness and height above the reservoir 92, are functions of the material properties of the porous material and the hand cleaner. Care should be taken to avoid too much evaporation of the hand cleaner from the porous material. However, this should be balanced in view of providing a moist hand contact section for delivering hand cleaner to a person when he contacts the appropriate portion of the assembly.

In the operating position depicted in FIGS. 4 and 9, the screen 64, which can be a metal screen or a plastic screen, is disposed on an exterior surface of the assembly 10 and the porous material 62 is sandwiched between the screen and the push plate 12. As more clearly seen in FIG. 4, the screen 64 is received in the rearward channels 80 and 84 of the handle bars 14 and 16, respectively. The screen 64 acts as a protective member for the porous material and includes openings through which the porous material can escape. As is apparent in FIG. 4, the push plate 12 is disposed in its rearward position in that the dove-tail portions of the barbs of the push plate are received in the rearward channels of the main housing 18.

Figure 10:
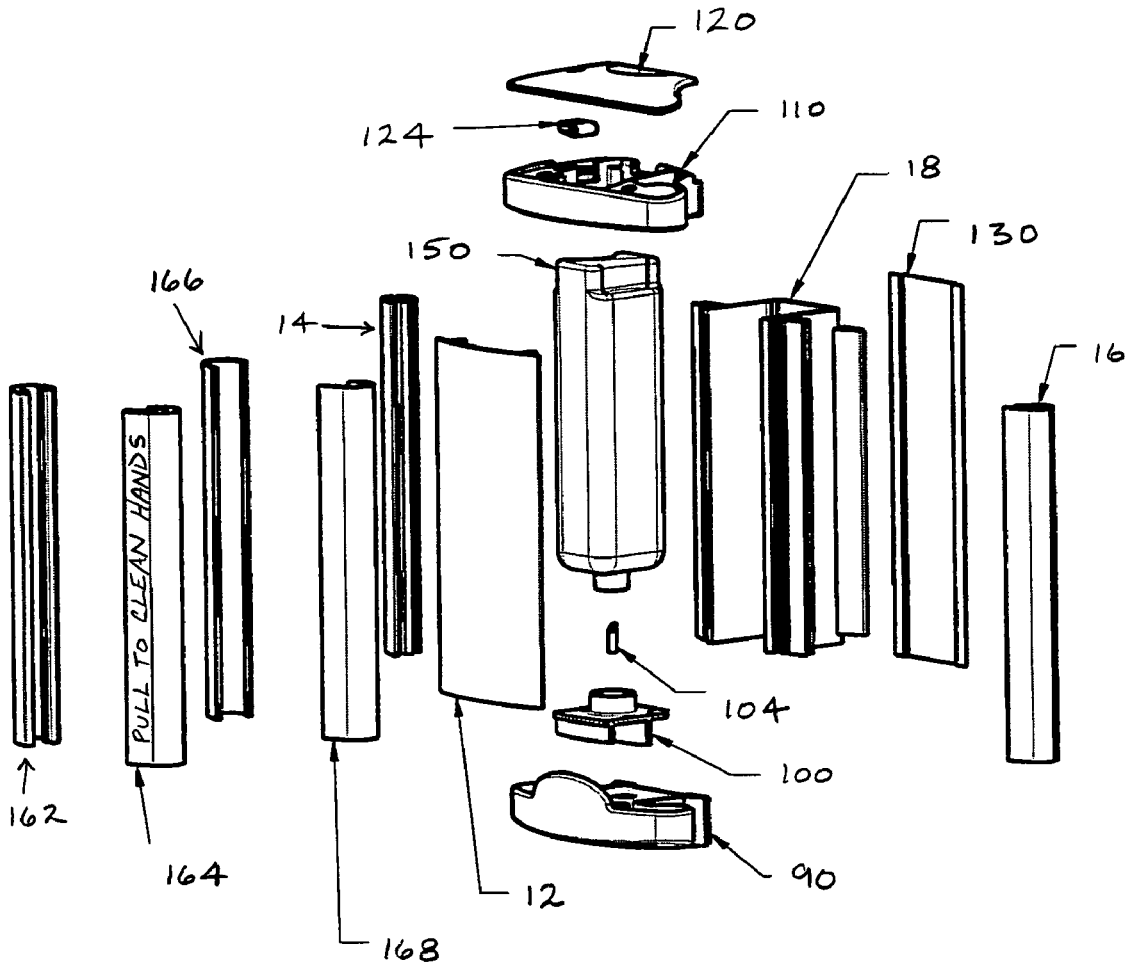
FIG. 10 is a exploded view of the dispenser of FIG. 1 showing a screen and porous material for use with the dispenser when used in a pull handle operating position.

With reference to FIG. 10, when the assembly 10 is positioned on a door in such a manner that to open the door a person typically grasps a handle and pulls the door, first and second screens 162 and 164, which are similar (other than its dimensions) to the screen 64 described above, wrap around the first and second handles 14 and 16, respectively. The screens 162 and 164 sandwich porous material 166 and 168, which is similar (other than its dimensions) to the porous material 62 described above, around the handles 14 and 16. Even though it is not shown in FIG. 4, the first screen 162 would be received inside both channels 80 and 82 of the first handle 14. Similarly, the second screen 164 would be received inside both channels 84 and 86 of the second handle 16. When the assembly 10 is in the operating position where the assembly typically operates as a pull handle for a door, the push plate 12 can be positioned in the forward position so that the exterior surface 22 of the push plate is substantially flush with an exterior surface of the respective screens 162 and 164. Such a configuration can limit the amount of evaporation of the cleaning solution from the porous material, since the exposed surface area is reduced as compared to having the assembly remain in the operating position where it can operate both as a pull handle and push plate handle.

When a person wants to enter or exit through a doorway having a door to which the assembly 10 is attached, a hand cleaning liquid is automatically deposited on his hands when he pushes or grasps the assembly. Instructions can be provided (see FIGS. 9 and 10) to inform the person.

The door handle dispensing assembly has been described with reference to the above disclosed embodiments. The invention is not limited to only the embodiment described above. Instead, the invention is broadly defined by the appended claims and the equivalents thereof.

The invention claimed is:

1. A door handle and liquid dispensing apparatus comprising:

a housing configured to attach to an associated door, the housing including a reservoir configured to hold a liquid for cleaning a person's hands;

a porous material disposed in and extending vertically up and away from an opening to the reservoir, a portion of the porous material being disposed adjacent a location typically touched by the person's hand when opening the associated door;

a push plate disposed to support the porous material; and, a protective member disposed adjacent an exterior surface of the porous material, the protective member including openings through which a liquid may pass from the porous material whereby the disposition of the porous material sandwiched between the push plate and protective member wicks the liquid from the reservoir to the protective member for deposition upon the person's hands upon use of the handle.

2. The apparatus of claim 1, wherein said push plate is connected to the housing.

3. The apparatus of claim 2, wherein the housing and the push plate cooperate with one another such that the push plate connects to the housing at a first operating position and a second operating position, when in the first operating position the push plate provides a contact surface against which the person opening the associated door presses against when opening the door.

4. The apparatus of claim 2, wherein the porous material is disposed adjacent an exterior surface of the push plate.

5. The apparatus of claim 4, wherein the porous material is disposed adjacent an exterior surface of the housing.

6. The apparatus of claim 1, further comprising a handle connected to the housing, the handle being configured to be grasped by the person when opening the associated door.

7. The apparatus of claim 1, further comprising a bottle piercing member connected to the housing for piercing a sealed bottle containing hand cleaning liquid.

8. The apparatus of claim 1, wherein the protective member comprises a metal screen or a plastic screen.

9. The apparatus of claim 8 wherein the screen is sized to inhibit evaporation of the liquid from the porous material during times of non-touching by a user's hands.

10. The apparatus of claim 1, further comprising a bottle having a sealed cap that is configured to be pierced, the bottle being disposed in the housing.

11. The apparatus of claim 1 wherein the push plate, porous material and protective cover are disposed to shield the reservoir from the person's hands.

* * * * *